US009403049B2

(12) United States Patent
Harada et al.

(10) Patent No.: US 9,403,049 B2
(45) Date of Patent: Aug. 2, 2016

(54) EXERCISE DEVICE

(71) Applicants: John Harada, Kailua, HI (US); John Godoy, Chicago, IL (US)

(72) Inventors: John Harada, Kailua, HI (US); John Godoy, Chicago, IL (US)

(73) Assignee: ACTIVE IDEAS LLC, Chicago, IL (US)

( * ) Notice: Subject to any disclaimer, the term of this patent is extended or adjusted under 35 U.S.C. 154(b) by 0 days.

(21) Appl. No.: 14/792,999

(22) Filed: Jul. 7, 2015

(65) Prior Publication Data

US 2015/0306449 A1 Oct. 29, 2015

Related U.S. Application Data

(60) Provisional application No. 62/032,698, filed on Aug. 4, 2014, provisional application No. 62/062,251, filed on Oct. 10, 2014.

(51) Int. Cl.

| | |
|---|---|
| ***A63B 21/02*** | (2006.01) |
| ***A63B 22/00*** | (2006.01) |
| ***A63B 22/14*** | (2006.01) |
| ***A63B 22/16*** | (2006.01) |
| ***A63B 22/18*** | (2006.01) |

(Continued)

(52) U.S. Cl.

CPC ..... *A63B 21/028* (2013.01); *A63B 22/0048* (2013.01); *A63B 22/14* (2013.01); *A63B 22/16* (2013.01); *A63B 22/18* (2013.01); *A63B 7/00* (2013.01); *A63B 71/0619* (2013.01); *A63B 2022/0038* (2013.01); *A63B 2022/185* (2013.01); *A63B 2071/0063* (2013.01); *A63B 2208/0233* (2013.01); *A63B 2220/40* (2013.01); *A63B 2225/50* (2013.01)

(58) Field of Classification Search

CPC ..... A63B 7/00; A63B 7/02; A63B 7/04; A63B 7/045; A63B 7/08; A63B 7/085; A63B 9/00; A63B 2009/002; A63B 2009/004; A63B 2009/006; A63B 2009/008; A63B 17/00; A63B 17/02; A63B 17/04; A63B 21/00043; A63B 21/00185; A63B 21/02; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/16; A63B 21/1609; A63B 21/1618; A63B 21/1627; A63B 21/1636; A63B 21/1645; A63B 21/1654; A63B 21/1663; A63B 21/1672; A63B 21/1681; A63B 21/169; A63B 21/4027; A63B 21/4033; A63B 21/4034; A63B 21/4045; A63B 21/4047; A63B 21/4049; A63B 22/14; A63B 22/16; A63B 22/18; A63B 23/0216; A63B 23/04; A63B 23/08; A63B 23/085; A63B 23/10; A63B 26/00; A63B 26/003; A63B 2026/006; A63B 2208/0233

See application file for complete search history.

(56) References Cited

U.S. PATENT DOCUMENTS

| | | | |
|---|---|---|---|
| 402,130 | A | 4/1889 | Bedford |
| 2,644,688 | A | 7/1953 | Roberge |

(Continued)

*Primary Examiner* — Oren Ginsberg
*Assistant Examiner* — Gary D Urbiel Goldner
(74) *Attorney, Agent, or Firm* — David L. Oppenhuizen; Oppenhuizen Law PLC

(57) ABSTRACT

A suspended footrest device for supporting and exercising a user's feet and legs. The footrest device includes a pair of footrests that are pivotally connected to the opposed ends of a rigid elongated member. A non-rigid suspension member is connected to a medial section of the elongated member to suspend the footrests. The footrests are pivotally connected to the rigid elongated member.

11 Claims, 3 Drawing Sheets

(51) Int. Cl.

| | |
|---|---|
| *A63B 71/06* | (2006.01) |
| *A63B 7/00* | (2006.01) |
| *A63B 71/00* | (2006.01) |

(56) References Cited

U.S. PATENT DOCUMENTS

| | | | | |
|---|---|---|---|---|
| 3,069,160 | A * | 12/1962 | Bulecki | A63B 22/18 472/19 |
| 3,108,802 | A * | 10/1963 | Sundquist | A63B 22/16 280/12.1 |
| 3,961,822 | A | 6/1976 | Daniel | |
| 4,013,318 | A * | 3/1977 | Piper | A63C 11/001 280/809 |
| 4,390,177 | A * | 6/1983 | Biran | A63B 21/1609 188/83 |
| 4,556,252 | A * | 12/1985 | Serex | A63C 11/00 280/809 |
| 4,913,423 | A | 4/1990 | Farran et al. | |
| 5,044,633 | A | 9/1991 | Rice | |
| 5,160,303 | A | 11/1992 | Smith | |
| 5,292,296 | A * | 3/1994 | Davignon | A63B 22/16 472/135 |
| 5,314,392 | A | 5/1994 | Hawkins et al. | |
| 5,391,134 | A * | 2/1995 | Heatwole | A63B 26/003 482/123 |
| 5,599,260 | A | 2/1997 | Rovinsky et al. | |
| 5,795,277 | A * | 8/1998 | Bruntmyer | A63B 21/0004 280/87.041 |
| 5,813,947 | A | 9/1998 | Densmore | |
| 5,855,538 | A | 1/1999 | Argabright | |
| 5,863,282 | A | 1/1999 | Moossun | |
| 5,906,561 | A * | 5/1999 | Lin | A63B 22/001 482/52 |
| 6,099,445 | A | 8/2000 | Rovinsky et al. | |
| 6,120,424 | A * | 9/2000 | Arline | A63B 21/0004 482/121 |
| 6,306,068 | B1 * | 10/2001 | Heatwole | A63B 21/0004 482/146 |
| 6,849,035 | B2 | 2/2005 | DuVernay et al. | |
| 6,926,650 | B2 | 8/2005 | Endelman et al. | |
| 7,104,937 | B2 | 9/2006 | Arbuckle et al. | |
| 7,278,956 | B1 * | 10/2007 | Chen | A63B 22/0605 472/21 |
| 7,419,459 | B2 * | 9/2008 | Van Straaten | A63B 22/14 482/146 |
| 7,537,553 | B2 | 5/2009 | Mongelluzzo et al. | |
| 7,614,991 | B2 | 11/2009 | Fox | |
| 7,780,584 | B2 | 8/2010 | Alexander | |
| 7,922,627 | B2 * | 4/2011 | Clark | A63B 21/15 482/51 |
| 7,981,005 | B1 * | 7/2011 | Tsai | A63B 21/055 482/147 |
| 8,061,278 | B2 | 11/2011 | Skiba | |
| 8,157,714 | B2 | 4/2012 | Mayr | |
| 8,394,005 | B2 | 3/2013 | Solow et al. | |
| 8,434,824 | B2 | 5/2013 | Spinabella et al. | |
| 8,512,210 | B2 | 8/2013 | Shauli | |
| 8,534,762 | B2 * | 9/2013 | Linhoff | A47C 7/506 297/423.26 |
| 8,951,174 | B2 * | 2/2015 | Huang | A61H 23/0263 482/111 |
| 2002/0137610 | A1 * | 9/2002 | Broudy | A63B 22/14 482/147 |
| 2002/0160888 | A1 * | 10/2002 | Chen | A63B 25/08 482/77 |
| 2004/0053756 | A1 | 3/2004 | Tremayne | |
| 2004/0142797 | A1 | 7/2004 | Andre | |
| 2005/0054492 | A1 | 3/2005 | Neff | |
| 2006/0189459 | A1 * | 8/2006 | Hsu | A63B 21/0004 482/125 |
| 2006/0197330 | A1 * | 9/2006 | Dekker | A63B 7/00 280/775 |
| 2008/0125294 | A1 * | 5/2008 | Takizawa | A61H 1/024 482/92 |
| 2009/0203502 | A1 * | 8/2009 | Neuberg | A63B 22/0048 482/70 |
| 2010/0152004 | A1 | 6/2010 | Feltz | |
| 2010/0167882 | A1 * | 7/2010 | Colk | A63B 7/00 482/71 |
| 2010/0234192 | A1 * | 9/2010 | Oller, Jr. | A63B 21/00047 482/131 |
| 2010/0261583 | A1 * | 10/2010 | Ferguson | A63B 21/4025 482/79 |
| 2011/0172071 | A1 * | 7/2011 | Piane, Jr. | A63B 22/18 482/142 |
| 2011/0275487 | A1 * | 11/2011 | Richards | A63B 21/0084 482/57 |
| 2011/0294633 | A1 | 12/2011 | Esrick et al. | |
| 2012/0295771 | A1 | 11/2012 | LaGree | |
| 2013/0203569 | A1 | 8/2013 | Athis | |
| 2015/0045193 | A1 * | 2/2015 | Morton | A63B 21/0552 482/123 |
| 2015/0202110 | A1 * | 7/2015 | Leier | A63B 21/00054 601/84 |

* cited by examiner

EXERCISE DEVICE

CROSS REFERENCE TO RELATED APPLICATION

This application claims the benefit of U.S. Provisional Application 62/032,698, which was filed on Aug. 4, 2014, and U.S. Provisional Application 62/062,251, which was filed on Oct. 10, 2014, the disclosures of which are hereby incorporated by reference.

BACKGROUND OF THE INVENTION

1. Field of the Invention

The present invention pertains to a suspended exercise device. More particularly, the present invention pertains to a suspended exercise device which a user places his or her feet upon to exercise while sitting down.

2. Description of the Prior Art

The mental and physical health benefits of exercise are well known. The physical benefits include reduced risk of heart disease and high blood pressure. Additionally, extended periods of time spent working at a desk or studying may be harmful if that activity is an impediment to the amount of exercise that one can get each day. It has been shown that not moving while working or studying at a desk may cause postural fixity, which is the static loading of the musculoskeletal system. Postural fixity may cause back, neck, shoulder and other pain. Extended periods of time spend sitting at a desk can also lead to obesity when paired with a poor diet because the individual is simply not burning calories to inactivity.

The mental health benefits of exercise include reduced depression and anxiety, and improved psychological well-being.

In the prior art there exists various exercise devices which can be used with a desk and/or a desk chair. However, each of these devices requires active participation and focus from the user. In this respect, these devices may be a distraction to the user while the user is attempting to study or work. Thus, the act of exercising is still in conflict with the user's study or work.

There remains a need for an exercise device which can be used as an "unconscious" device in which the user does not necessarily have to perform active exercises in order to reap the benefits of the device. This type of device would allow the user to burn calories while they are not actively exercising.

The present invention, as detailed hereinbelow, seeks to fill this need by providing a suspended footrest device which can be easily installed in any suitable location and used either actively or passively to provide movement and exercise to a user in a seated position.

SUMMARY OF THE INVENTION

The present invention provides a suspended footrest device comprising: (a) a pair of footrests; (b) a rigid elongated member having a pair of opposed ends and a medial section, each of the footrests being pivotally connected to a respective one of the ends of the elongated member; and (c) at least one a non-rigid suspension member having a first end connected to the rigid elongated member, and a second end connected to a fixed location for suspension of the footrest device therefrom.

Optionally, the suspended footrest device can include a ball-and-socket joint connected between each footrest and the respective end of the rigid elongated member to allow pivotal movement between each footrest and the rigid elongated member.

Optionally, the suspended footrest device can include a rotatable turntable connected between each footrest and the respective end of the rigid elongated member to allow rotational movement between each footrest and the rigid elongated member.

Optionally, the first end of the suspension member is connected to the medial section of the elongated member.

The suspension member may be either elastic or inelastic.

The suspended footrest can also optionally include a damper positioned between each footrest and the respective end of the rigid elongated member for dampening the pivotal movement of the ball-and-socket joint.

Additionally, the suspended footrest device can include a rigid elongated support member having a first end and a second end. The first end is connected to a chair, and the second end is connected to the second end of the non-rigid suspension member. The footrests and the rigid elongated member are thus suspended by the rigid elongated support member and the non-rigid suspension member.

For a more complete understanding of the present invention, reference is made to the following detailed description and accompanying drawings. In the drawings, like reference characters refer to like parts throughout the views in which:

DETAILED DESCRIPTION OF THE PREFERRED EMBODIMENT

Figure 1:
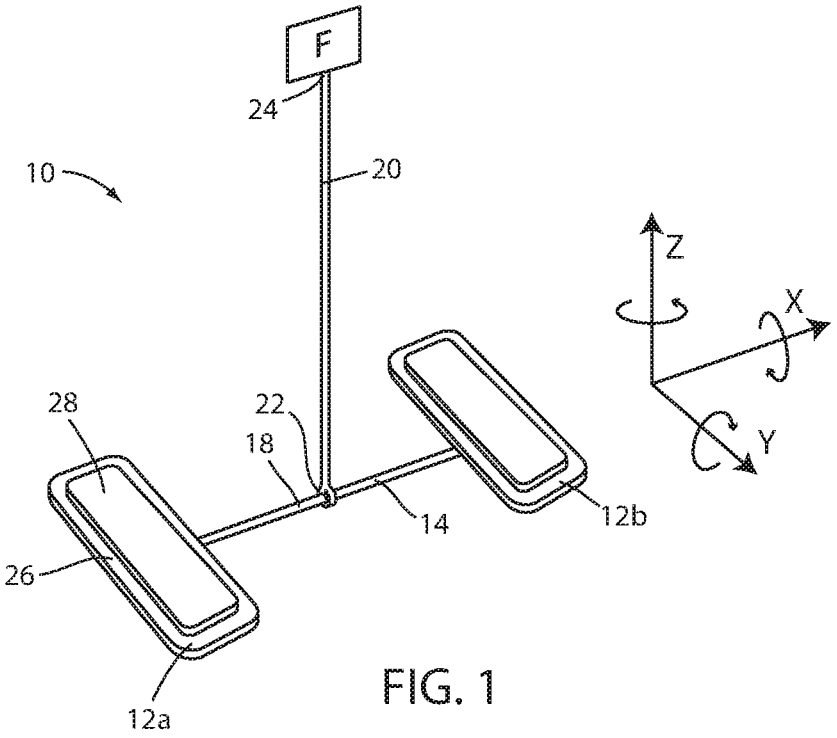
FIG. 1 is a perspective view of a first embodiment of the present invention hereof.
Figure 2:
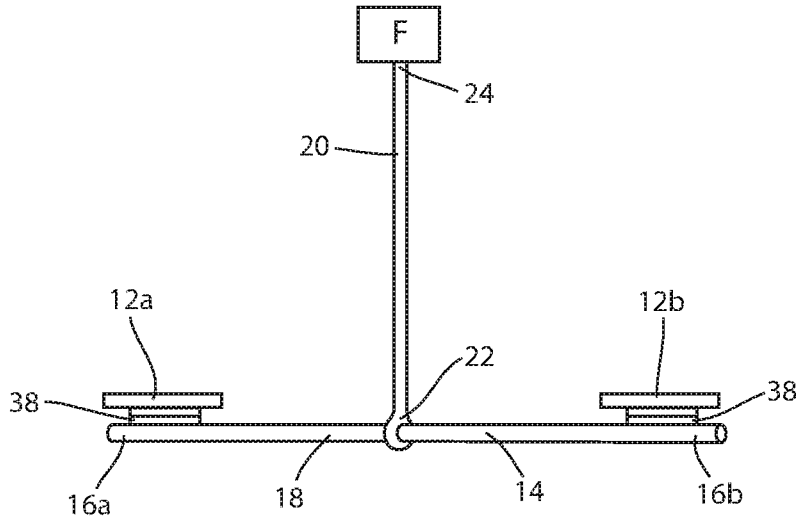
FIG. 2 is a front view of the first embodiment of the present invention.

In accordance with the present invention and as shown generally in FIGS. 1 and 2, there is provided a suspended footrest device 10 comprising: (a) a pair of footrests 12*a*,12*b*; (b) a rigid elongated member 14 having a pair of opposed ends 16*a*,16*b* and a medial section 18, each of the footrests 12*a*,12*b* being pivotally connected to a respective one of the ends 16*a*,16*b* of the elongated member 14; and (c) a non-rigid suspension member 20 having a first end 22 connected to the medial section 18 of the rigid elongated member 14, and a second end 24 connected to a fixed location F for suspension of the footrest device 10 therefrom.

The footrests 12*a*,12*b* include a rigid base platform 26 and are dimensioned to receive the feet of the user. The base platform 26 is preferably thin and planar and formed from a substantially rigid material, such as wood, metal, a plastic polymer, or the like. Each footrest 12*a*,12*b* can optionally include a top layer 28 having a pliable material for cushioning the user's feet which may or may not be contoured to the shape of a foot or a shoe. Any suitable type of pliable material that is well-known in the art can be used for the top layer 28. Optionally, each footrest 12*a*,12*b* can also include guide rails 30 along the front, back, or sides of each footrest 12*a*,12*b* to help the user keep his or her feet squarely positioned on each footrest 12*a*,12*b*.

In addition, each footrest 12*a*,12*b* can optionally include a bumper (not shown) formed from an elastomeric material along the front, back, or sides of the each footrest 12*a*,12*b* to keep the footrests 12*a*,12*b* from damaging any items or creating distracting noise when the footrests 12*a*,12*b* contact other items near the user.

The elongated member 14 is provided to connect the footrests 12*a*,12*b* to the non-rigid suspension member 20. The elongated member 14 has a pair of opposed ends 16*a*,16*b* and a medial section 18. Each of the footrests 12*a*,12*b* is pivotally connected to a respective one of the ends 16*a*,16*b* of the elongated member 14. The elongated member 14 can be formed from any suitable type of material, such as wood, metal, a plastic polymer, and so forth. The elongated member 14 can also have any suitable type of geometry, such as being solid or hollow, as well as having any suitable cross-sectional shape (e.g., triangular, rectangular, circular, etc.). As discussed further below, the medial section 18 of the elongated member 14 is connected to the non-rigid suspension member 20 for suspending the footrests 12*a*,12*b*.

Each of the opposed ends 16*a*,16*b* of the elongated member 14 are pivotally connected to a respective one of the footrests 12*a*,12*b*. More specifically, a bottom surface 32 of each base platform 26 is pivotally connected to the respective end 16*a*,16*b* of the elongated member 14.

The ends 16*a*,16*b* of the elongated member 14 can optionally each include a roller (not shown) to help eliminate any damaging contact between the side of the footrest 12*a*,12*b* or the end 16*a*,16*b* against the side of a desk or any other item.

Optionally, the footrests 12*a*,12*b* can also include means for moving the footrests 12*a*,12*b* out of the way of the user. For example, the footrests 12*a*,12*b* can include magnets (not shown) at the front or bottom of each footrest so that the user can store the footrest device 10 against a magnetic surface which can be placed wherever as desired by the user.

Figure 3:
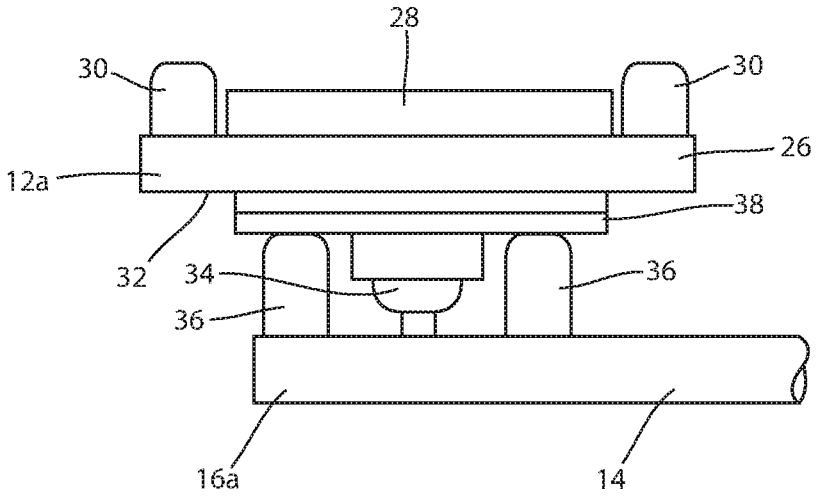
FIG. 3 is an enlarged front view showing one embodiment of the footrest being pivotally connected to an end of the elongated member.

As shown best in FIG. 3, the suspended footrest device 10 can optionally include a ball-and-socket joint 34 connected between each footrest 12*a*,12*b* and the respective end 16*a*, 16*b* of the elongated member 14 to allow the pivotal movement. A ball-and-socket joint is well-known to those having ordinary skill in the art, and it provides multi-axis movement of the footrest with respect to the elongated member 14. More specifically, and as shown best in FIG. 1, the ball-and-socket joint 34 allows each footrest 12*a*,12*b* to pivot front-to-back (about the x axis), side-to-side (about the y axis), and also rotate (about the z axis). Any suitable type of ball-and-socket joint which is commercially available can be used.

Figure 4:
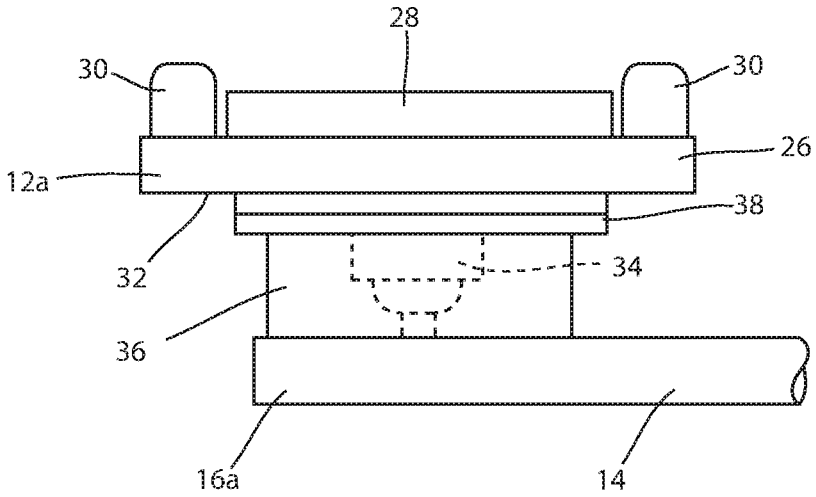
FIG. 4 is an enlarged front view showing another embodiment of the footrest being pivotally connected to an end of the elongated member.

A damper 36 may optionally be positioned between each footrest 12*a*,12*b* and the respective end 16*a*,16*b* of the elongated member 14 for dampening the pivotal movement of the ball-and-socket joint 34. Any suitable type of damper can be used. For example, and as shown in FIG. 4, the damper 36 can comprise a resiliently flexible elastomer that surrounds the ball-and-socket joint 34 and provides a moderate amount of resistance to movement by the ball-and-socket joint 34. And as shown in FIG. 3, the damper 36 can also comprise a plurality of elastomeric bumpers positioned at various locations around the ball-and-socket joint 34. The damper 36 can be positioned or designed so that it can dampen the movement of the ball-and-socket joint 34 in one axis, two axes, or three axes (i.e., the x, y, and z axes as shown in FIG. 1). Preferably, the damper 36 dampens the movement of the ball-and-socket joint 34 along the x and y axes.

In addition to the ball-and-socket joint 34, a rotatable turntable 38 can be connected between each footrest 12*a*,12*b* and the respective end 16*a*,16*b* of the elongated member 14 to allow rotational movement about the axis between each footrest 12*a*,12*b* and the elongated member 14. Any suitable type of rotatable turntable can be used. Preferably, the rotatable turntable 38 includes a circular track and ball bearings to facilitate smooth and low-resistance rotational movement.

It is to be understood that either the ball-and-socket joint 34 or the rotatable turntable 38 can be used, as well as possibly both the ball-and-socket joint 34 and the rotatable turntable 38 (as shown in FIGS. 3 and 4). When both are used, the rotatable turntable 38 is preferably connected directly to the bottom surface 32 of the base platform 26 and the ball-and-socket joint 34 is preferably connected directly to the end of the elongated member 14. The bottom of the rotatable turntable 38 and the top (socket) of the ball-and-socket joint 34 are then connected directly to each other.

There is also provided at least one suspension member 20 having a first end 22 connected to the elongated member 14, and a second end 24 connected to a fixed location F for suspension of the footrest device 10 therefrom. Preferably the first end 22 is connected to the medial section 18 of the elongated member 14. The suspension member 20 can be either rigid or non-rigid, but preferably the suspension member 20 is non-rigid. When the suspension member 20 is rigid, it is flexibly connected at the ends 22,24 to both the elongated member 14 and the fixed location F to allow free-hanging movement of the footrests 12*a*,12*b* from the fixed location F. The suspension member 20 can be formed from any suitable type of material, including but not limited to, a rigid bar, a non-rigid cable, a rope, a non-rigid length of a polymeric material, a chain, and so forth.

The suspension member 20 may be either elastic or inelastic. That is, the suspension member 20 may be stretchable or have a fixed length, as well as have different elastic and inelastic sections.

The suspension member 20 may optionally include a quick-release mechanism (not shown) to allow the footrest device 10 to be quickly and easily removed from the fixed location F when it is desired. Any suitable type of quick-release mechanism that is well-known in the art can be used herewith, including a buckle, clasp, and so forth.

As mentioned above, the second end 24 of the suspension member 20 is connected to a fixed location F. The "fixed location F" is intended to encompass any peripheral structure from which the suspended footrest can be supported and suspended. For example, when the suspended footrest device 10 is used at a desk, the fixed location F can be the bottom surface 32 of the desktop. The second end 24 of the suspension member 20 can be secured to the fixed location F using any suitable type of means for securing, such as an adhesive, a clamp, a mechanical device (e.g., a hook, an eye bolt), and so forth.

Figure 5:
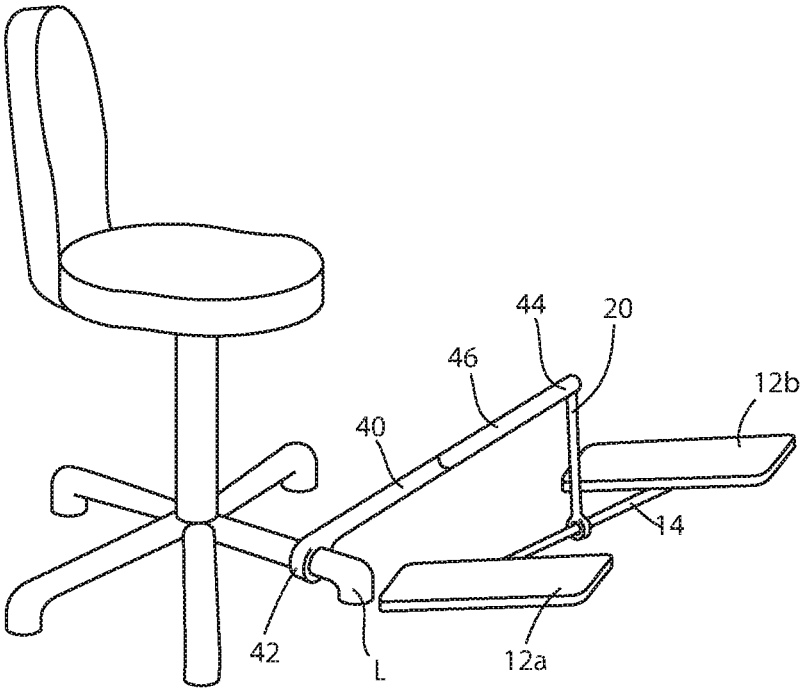
FIG. 5 is a perspective view showing a second embodiment of the invention in which the footrests are suspended directed from a support member that is connected to the user's chair.

Alternatively, and as shown in FIG. 5, the suspended footrest device 10 can include a rigid elongated support member 40 having a first end 42 and a second end 44 from which the suspension member 20 can be attached. In one embodiment, the first end 42 is rigidly connected to a leg L of a chair, and the second end 44 is connected to the second end 24 of the non-rigid suspension member 20. The support member 40 shown in FIG. 5 extends 16*a*,16*b* directly from the leg L of the chair to the suspension member 20 as a substantially straight member. However, the support member 40 can have any suitable shape or geometry. For example, the support member 40 could have an arcuate shape in which the support member 40 extends 16*a*,16*b* away from the chair and then arcs upwardly and back toward the chair so that the support member 40 does not interfere with the user's legs or feet. The footrests 12*a*,12*b* and the elongated member 14 are thus suspended by the rigid elongated support member 40 and the non-rigid suspension member 20. In this regard, the suspended footrest device 10 can be moved along with the user's chair.

The support member 40 can also optionally include an extendable section 46 at one of the ends 16*a*,16*b* to allow the second end 44 to be temporarily moved (such as during an active exercise or during a particular movement by the user). The extendable section 46 can include a spring (not shown) or other suitable type of biasing device for returning the extendable section 46 back to its retracted position.

The suspended footrest device 10 is designed as an unconscious exercise device. This means that when a user puts his or her feet on the footrests 12*a*,12*b* while they are suspended, the user will need to make small adjustments of his or her body in order to keep the suspended footrest device 10 in a neutral position. In order to do this, the user may apply small amounts of force in a multitude of directions, however the movements are so small that there will be only a small degree of physical movement visible to the naked eye.

The suspended footrest device 10 is an instability exercise apparatus upon which the user or exerciser places his or her feet and is forced unconsciously to stabilize their feet thereby creating small muscular contractions. In this regard, the user is not distracted from his or her work or study by consciously thinking about the exercise. Rather, the user gets exercise from the suspended footrest device 10 simply by controlling the position of his or her feet and legs on the footrests 12*a*,12*b* during use.

In addition, the footrest device 10 can also optionally include a plurality of accelerometers or other electromechanical devices for detecting and measuring movement. These measuring devices can then be used to supply movement data to a computer-readable software program which can be designed to record the amount of movement by the user and calculate the total number of calories burned, equivalent miles walked, and so forth. Preferably, the software can be fed live movement data using Bluetooth® or other similar type of wireless communication.

According to the invention described above, an exercise device is provided which can be used as an "unconscious" device in which the user does not necessarily have to perform active exercises in order to reap the benefits of the device.

As is apparent from the preceding, there is provided a suspended footrest device which can be easily installed in any suitable location and used either actively or passively to provide movement and exercise to a user in a seated position.

What is claimed is:

1. A suspended footrest device for suspension from a fixed location, the footrest device comprising:

(a) a pair of spaced-apart footrests;

(b) a rigid elongated member extending laterally along the length thereof between the footrests, the elongated member having a pair of opposed ends and a medial section, and a first one of the ends extending toward a first one of the footrests, and a second one of the ends extending toward a second one of the footrests, the first one of the footrests being pivotally connected to the first one of the ends of the elongated member, and the second one of the footrests being pivotally connected to the second one of the ends of the elongated member, whereby each pivotally connected pair of the ends and footrests are pivotally connected to each other along at least two axes to permit simultaneous relative movement therebetween in at least two planes; and (c) at least one flexible and non-rigid suspension member having a first end connected to the medial section of the elongated member, and a second end connected to the fixed location for suspension of the footrest device therefrom.

2. The suspended footrest device of claim 1 including a ball-and-socket joint connected between each footrest and the respective end of the elongated member to allow pivotal movement between each footrest and the elongated member.

3. The suspended footrest of claim 2 wherein the suspension member is elastic.

4. The suspended footrest of claim 2 wherein the suspension member is inelastic.

5. The suspended footrest of claim 2 including a rotatable turntable connected between each footrest and the respective end of the elongated member to allow rotational movement between each footrest and the elongated member.

6. The suspended footrest of claim 2 including a damper positioned between each footrest and the respective end of the elongated member for dampening the pivotal movement of the ball-and-socket joint.

7. The suspended footrest of claim 1 including a rotatable turntable connected between each footrest and the respective end of the elongated member to allow rotational movement between each footrest and the elongated member.

8. The suspended footrest of claim 1 wherein the suspension member is elastic.

9. The suspended footrest of claim 1 wherein the suspension member is inelastic.

10. The suspended footrest of claim 1 wherein the first one of the footrests is positioned atop the first one of the ends of the elongated member, and the second one of the footrests is positioned atop the second one of the ends of the elongated member.

11. A suspended footrest device for suspension from a fixed location, the footrest device consisting of:

(a) a pair of footrests;

(b) a rigid elongated member having a pair of opposed ends and a medial section, each of the footrests being pivotally connected to a respective one of the ends of the elongated member, the footrests being configured to permit simultaneous movement in three planes between the footrests and the ends of the elongated member; and (c) a flexible and non-rigid suspension member having a first end connected to the elongated member, and a second end connected to ft the fixed location for suspension of the footrest device therefrom.

* * * * *